US005331981A

United States Patent [19]

Tamaoki et al.

[11] Patent Number: 5,331,981

[45] Date of Patent: Jul. 26, 1994

[54] SMOKING ARTICLE HAVING FLAVOR SOLUTION RELEASABLY HOUSED IN A PLASTIC CONTAINER

[75] Inventors: Akimichi Tamaoki; Shizuo Suhara; Morio Kondoh, all of Yokohama, Japan

[73] Assignee: Japan Tobacco Inc., Tokyo, Japan

[21] Appl. No.: 835,924

[22] PCT Filed: May 21, 1991

[86] PCT No.: PCT/JP91/00675

§ 371 Date: Mar. 2, 1992

§ 102(e) Date: Mar. 2, 1992

[87] PCT Pub. No.: WO92/01487

PCT Pub. Date: Feb. 6, 1992

[30] Foreign Application Priority Data

Jul. 18, 1990 [JP] Japan ..... 2-187924

[51] Int. Cl.[5] ..... A24D 3/06

[52] U.S. Cl. ..... 131/337; 131/335; 131/341

[58] Field of Search ..... 131/331, 335, 337, 341, 131/342

[56] References Cited

U.S. PATENT DOCUMENTS

| | | | |
|---|---|---|---|
| 3,101,723 | 8/1963 | Seligman et al. | 131/342 |
| 3,347,231 | 10/1967 | Chang . | |
| 3,502,084 | 3/1970 | Carty | 131/337 |
| 4,372,328 | 2/1983 | Kausch et al. | 131/332 |
| 4,865,056 | 9/1989 | Tamaoki et al. . | |
| 5,019,122 | 5/1991 | Clearman et al. . | |
| 5,022,964 | 6/1991 | Crane et al. | 131/341 X |

FOREIGN PATENT DOCUMENTS

| | | |
|---|---|---|
| 0192950 | 9/1986 | European Pat. Off. . |
| 0244684 | 11/1987 | European Pat. Off. . |
| 0276021 | 7/1988 | European Pat. Off. . |
| 62-22583 | 4/1987 | Japan . |
| 62-20284 | 12/1987 | Japan . |
| 64-37347 | 2/1989 | Japan . |
| 64-71469 | 3/1989 | Japan . |
| 1204018 | 9/1970 | United Kingdom . |

*Primary Examiner*—Jessica J. Harrison
*Assistant Examiner*—Jennifer Doyle

[57] ABSTRACT

A smoking article includes a flexible casing which is liquid-tight and tubular, a mouth portion formed at one end of the casing, a cylindrical plastic container which can be elastically deformed and is arranged within the casing, a flavour solution housed in the plastic container and having a viscosity of 520 cP or less, a thin wall portion formed at one end wall of the plastic container, the thin wall portion being broken when the plastic container is elastically deformed upon receipt of force applied from outside the casing so as to permit release of the flavour solution, and a water absorbing layer formed adjacent to the end wall having the thin wall portion formed therein so as to hold the flavour solution released from the plastic container. Various kinds of flavour solutions can be used in the smoking article. The amount of the volatile aromatic components can be controlled easily. Further, it is possible to suppress the loss of the aromatic component during preservation of the smoking article.

3 Claims, 2 Drawing Sheets

SMOKING ARTICLE HAVING FLAVOR SOLUTION RELEASABLY HOUSED IN A PLASTIC CONTAINER

TECHNICAL FIELD

The present invention relates to a smoking article used for inhaling and tasting volatile components of a flavour.

BACKGROUND ART

Known is a cylindrical instrument housing a flavour in its axial bore. This instrument comprises a cylindrical body housing the flavour. The volatile components of the flavour are sucked through a mouth portion formed at one end of the cylindrical body. The flavour is solid, which is granular or in the form of chips or tablets shaped from a powdery material. The solid flavour is directly held within the axial bore of the cylindrical body.

In the conventional instrument described above, the kinds of the solid flavours having a volatility sufficient for the sucking are very much restricted. Also, since the flavour is solid, it is difficult to control the amount of the volatile aromatic components of the flavour. Further, since the flavour is exposed directly to the atmosphere within the axial bore of the instrument, the aromatic components are evaporated or denatured during preservation, making it difficult to preserve the instrument over a long period of time.

It may be possible to use a flavour solution supported by a suitable carrier in place of the solid flavour. In this case, it is possible to house various kinds of flavours in the axial bore of the cylindrical body. It is also possible to control the amount of the aromatic components evaporated from the flavour. However, a solution is more volatile in general than a solid, making it more difficult to preserve the instrument housing a flavour solution over a long period of time. In addition the solution tends to ooze out of the cylindrical body.

DISCLOSURE OF THE INVENTION

The present invention is intended to provide a smoking article which permits using various kinds of flavours, easily controlling the amount of the volatile fragrant components, and suppressing the loss of the flavour during preservation.

According to the present invention, there is provided a smoking article, comprising a flexible casing which is liquid-tight and tubular, a mouth portion formed at one end of the casing, a cylindrical plastic container which can be elastically deformed and is arranged within the casing, a flavour solution housed in the plastic container and having a viscosity of 520 cP or less, a thin wall portion formed at one end wall of the plastic container, the thin wall portion being broken when the plastic container is elastically deformed upon receipt of force applied from outside the casing so as to permit release of the flavour solution, and a water absorbing layer formed adjacent to the end wall having said thin wall portion formed therein so as to hold the flavour solution released from the plastic container.

BEST MODE FOR EMBODYING THE INVENTION

Figure 1:
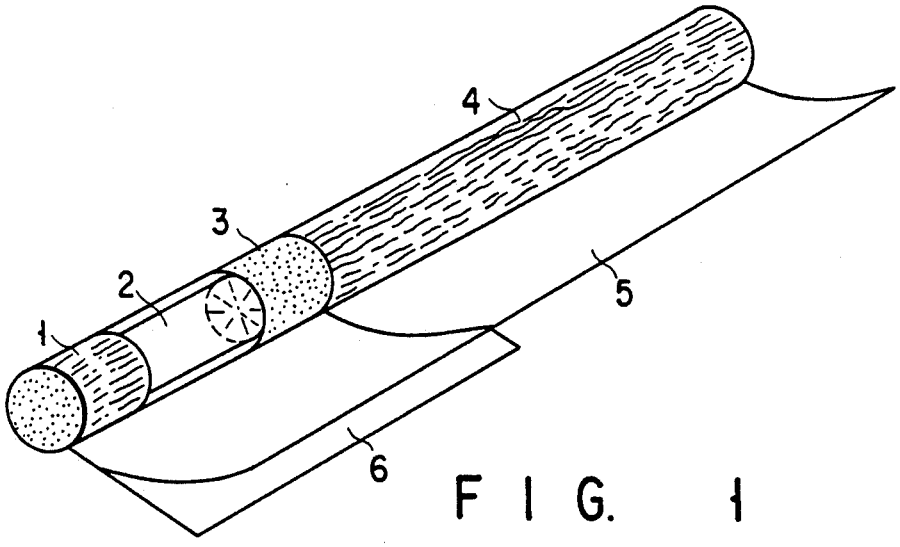
FIG. 1 is an oblique view, partly broken away, showing a smoking article according to one embodiment, of the present invention.

The term "smoking article" used herein is irrelevant to tobacco and denotes an article used for inhaling and tasting a volatile aromatic component evaporated or an aerosol of aromatic components formed from flavour or the like.

In the smoking article of the present invention, a flavour solution is housed in a plastic container included in the smoking article. The flavour solution can be prepared by adding water to a flavour composition. It is possible to use various kinds of water-soluble flavour compositions including, for example, compositions of tobacco type, menthol type, vanilla type, liquor type, honey type, chocolate type, dry fruit type, cinnamon type, fruit type, and maple type. The concentration of the flavour solution is related to the intensity of the taste and aroma which is inhaled and tasted. In other words, the intensity of the taste and aroma can be controlled by changing the concentration of the flavour solution. Also, the flavour solution should have a low viscosity such that the solution can be released from the plastic container arranged within the smoking article. To be more specific, the viscosity should be at most 520 cP and should be as low as possible.

The flavour solution released from the plastic container is absorbed and held by the water absorbing layer. In the present invention, an unwoven fabric prepared by mixing a water absorbing fiber with another suitable fiber can be used for forming the water absorbing layer. If a heat fusible composite fiber is mixed with the water absorbing fiber, the unwoven fabric can be prepared without using a binder. The mixing ratio of the water absorbing fiber to the heat fusible composite fiber depends on the flavour solution to be absorbed, the size of the water absorbing layer or the like. The mixing ratio preferable falls, however, within a range of between 10:90 and 90:10, further preferably between 40:60 and 60:40. The unwoven fabric is shaped in the form of, for example, a rod so as to prepare the water absorbing layer. It is possible to use the water absorbing fiber alone. In this case, however, a large amount of water absorbing fiber is required for preparing a water absorbing region of a reasonable size. As a result, the resistance to air flow is increased when the water absorbing fiber is swollen by the absorption of the flavour solution, making it difficult to inhale the evaporated aromatic components.

It is desirable to mix another water absorbing material, e.g., shredded tobacco, with the unwoven fabric. In this case, the unwoven fabric is shredded or cut into small pieces substantially equal in length and width to the shredded tobacco. The shredded pieces are mixed with the shredded tobacco, and the resultant mixture is wrapped and rolled like cigarettes so as to prepare the water absorbing layer. In the case of using a water absorbing material such as shredded tobacco, is desirable to decrease the amount of the water absorbing fiber relative to the heat fusible composite fiber, compared with the use of the unwoven fabric alone.

In the smoking article of the present invention, it is possible to use various kinds of perfume compositions because a flavour composition is used in the form of aqueous solution. Also, the concentration of the aromatic components to be inhaled can be easily controlled by changing the concentration of the aqueous solution. Further, the quality of the flavour can be maintained until the flavour is tasted because the flavour solution is housed in a plastic container which can be easily ruptured. In addition, the flavour solution can be released to the outside by a very simple operation.

The flavour solution released from the plastic container is absorbed by the water absorbing layer disposed adjacent to the container so as to be held within the water absorbing layer. The particular construction permits a flavour solution to be housed in an amount large enough to taste the aromatic components of the flavour composition. In addition, the lips of a person using the smoking article and the fingers holding the smoking article are not stained with the flavour solution. Where the water absorbing layer contains shredded tobacco, aroma of tobacco can be imparted to the aromatic components.

The accompanying drawings show some embodiments of the present invention. Specifically, FIG. 1 is an oblique view showing a cigarette type smoking article according to one embodiment of the present invention. As shown in the drawing, the smoking article comprises a back-up filter 1, which is 8 mm long and consists of an acetate fiber having a fineness of 3Y/36,000, a plastic container 2, which is 14 mm long and has an inner volume of 220 μl, a water absorbing layer 3 which is 8 mm long, a supporting member 4 which is 54 mm long, a casing rolling paper 5, and a chip paper 6 equal in material to the casing rolling paper 5. The water absorbing layer 3 is prepared by shaping in the form of a rod an unwoven fabric consisting of 50 parts of Ranceal and 50 parts of ES fiber. The supporting member 4 is prepared by shaping in the form of a rod an EA fiber having a fineness of 4d/40,000. Further, the casing rolling paper 5 consists of a polyester film having an aluminum layer formed on each surface by vapor deposition and also having a paper sheet formed on the aluminum layer by means of dry lamination.

The term "Ranceal" noted above is a water absorbing fiber manufactured by Toyobo Ltd. and available on the market. Each of "ES fiber" and "EA fiber" noted above is a heat fusible composite fiber manufactured by Chisso Ltd. and available on the market. The ES fiber consists of a polypropylene core having a melting point of 160° C. and a cover layer formed of a high density polyethylene having a melting point of 130° C. On the other hand, the EA fiber consists of a polypropylene core having a melting point of 160° C. and a cover layer formed of a mixture of a low density polyethylene and ethylene-vinyl acetate copolymer (EVA), said mixture having a melting point of 110° C.

As shown in the drawing, the plastic container 2 is cylindrical, and a predetermined amount of a flavour solution is housed in the container 2. Where the smoking article shown in FIG. 1 is sized as described previously, 50 to 200 μl of flavour solution is housed in the container. As described previously, the viscosity of the flavour solution should be at most 520 cP and should desirably be as low as possible.

The back-up filter 1 is arranged as a mouth portion contiguous to one end of the plastic container 2. An acetate fiber can be used for forming the filter 1. In addition, it is possible to use a filter generally used cigarettes such as a pulp fiber and a hydrophobic heat fusible composite fiber for forming the back-up filter 1. Particularly, it is desirable to use an acetate fiber for forming the back-up filter 1.

The water absorbing layer 3 is arranged contiguous to the other end of the plastic container 2. The supporting member 4 is arranged contiguous to the other end of the water absorbing layer 3. The filter material generally used in cigarettes can also be used for forming the supporting member 4. However, it is desirable for the supporting member 4 to be formed of a heat fusible composite fiber in view of the air flowability and hardness. The outer surface of the array consisting of the filter 1, the plastic container 2, the water absorbing layer 3 and the supporting member 4 is wrapped with the casing rolling paper 5 and the chip paper 6, with the result that the entire structure forms an integral cylindrical article.

To be more specific, the casing rolling paper 5 and the chip paper 6 collectively form a liquid-tight, tubular flexible casing. A small clearance is formed between the casing and the plastic container 2 such that a gaseous material can be sucked through the back-up filter 1. Any material can be used for forming the casing rolling paper 5 as far as the paper 5 can be made liquid-tight. However, it is desirable to use a polyester film having an aluminum film formed on each surface by vapor deposition and also having a paper sheet formed on the aluminum film by means of dry lamination. In the case of an ordinary cigarette, the resistance of the filter to the air flow is 90 to 110 $mmH_2O$ where the cigarette is not lit, and 130 to 160 $mmH_2O$ where the cigarette is lit. In the smoking article of the present invention, it is desirable for the filter 1 to exhibit an air flow resistance nearly equal to that of the ordinary cigarette where the cigarette is not lit. It is desirable to set the air flow resistance at a low level in the present invention because a larger amount of gaseous component suction is required for satisfying the user of the smoking article in comparision with aerosol suction. More desirably, the air flow resistance should be set at 10 to 60 $mmH_2O$ for the back-up filter 1 and at 200 $mmH_2O$ or less for the entire smoking article.

Figure 2A:
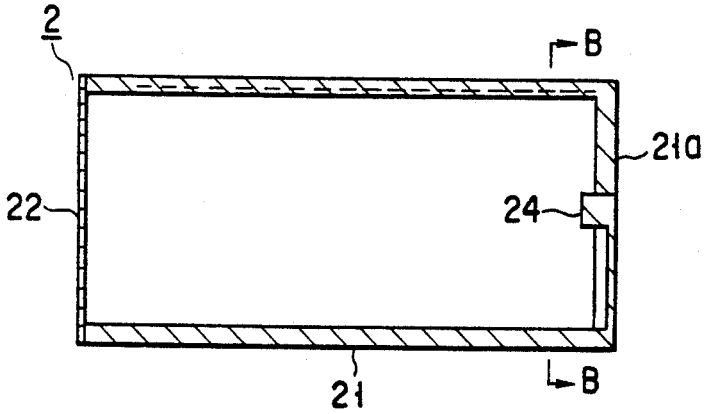
FIGS. 2A to 2C collectively illustrate a plastic container included in the smoking article shown in FIG. 1.
Figure 2B:
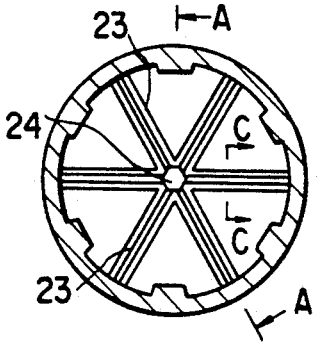
Figure 2C:
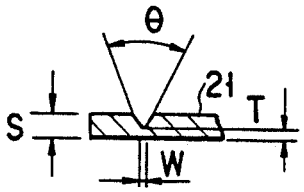

The construction of the plastic container 2 is shown in FIGS. 2A to 2C, in which FIG. 2A is a longitudinal cross sectional view, FIG. 2B is a lateral cross sectional view, i.e., cross section along line B—B shown in FIG. 2A, and FIG. 2C shows a cross section along line C—C shown in FIG. 2B. As shown in the drawings, the plastic container 1 comprises a cylindrical body 21 open at one end and a seal film 22 closing liquid-tight the open end of the cylindrical body 21. Thus, a suitable amount of a flavour solution can be housed in the container 2. The cylindrical body 21 can be formed of resins which can be elastically deformed easily including, for example, thermoplastic resins such as polyethylene, polyvinyl chloride, and a mixture thereof. Particularly, it is desirable to use a low density ethylene for forming the cylindrical body 21. The seal film 22, which consists of an aluminum foil laminated or coated with a thermoplastic resin, is thermally fused to the open end of the cylindrical body 21. It is also possible for the seal film 22 to consist of a thermoplastic resin sheet alone.

The containers described in Published Unexamined Japanese Patent Application No. 64-37347 can also be used in the present invention as the plastic container.

A plurality of grooves 23 providing a thin wall portion are formed in a wall 21*a* at the closed end of the cylindrical body 21 of the plastic container. As shown in FIG. 2B, these grooves 23 radially extend outward from a projection 24 formed in the center. FIG. 2C shows that the groove 23 is substantially of v-shape in cross section, the walls defining the groove 23 forming an interfacial angle $\theta$. A flat portion of a width W extends along the bottom of the groove 23. Naturally, the thickness T of the wall 21*a* in the region below the groove 23 is smaller than the thickness S of the wall 21*a* in the other region. The presence of the grooves 23 permits the wall 21*a* at the closed end of the cylindrical body 21 to be broken easily when the body 21 is elastically deformed upon receipt of external force. In order to ensure breakage of the wall 21*a*, it is desirable to form the grooves 23 such that: $\theta=35$ to 60°, W=0.2 mm, T=0.06 to 0.15 mm, S=0.3 to 0.6 mm. More desirably, T should be 0.15 mm and S should be 0.5 mm.

In using the smoking article of the particular construction for tasting the aromatic components of a flavour, the casing formed by winding the casing rolling paper 5 and the chip paper 6 is pushed from outside by fingers so as to elastically deform the plastic container 2. As a result, the wall 21*a* of the cylindrical body 21 is broken so as to release the flavour solution from within the plastic container 2. The flavour solution thus released is absorbed by and held in the water absorbing layer 3 arranged continuous to the plastic container 2. Since aromatic components are evaporated from the released flavour solution, the aromatic components can be sucked through the back-up filter 1 and inhaled by the user so as to taste the aromatic components.

In the smoking article shown in FIG. 1, the water absorbing layer 3 is formed of an unwoven fabric consisting of 50 parts by Ranceal and 50 parts of ES fiber, as described previously. Alternatively, shredded tobacco can be mixed in the water absorbing layer 3. In this case, the unwoven fabric noted above is cut into small pieces, and 10% of the cut pieces is mixed with shredded tobacco which absorbs water. Then, the resultant mixture is shaped into a roll so as to prepare the water absorbing layer 3. In the case of using another water absorbing material such as shredded tobacco, it is desirable to lower the mixing ratio of a water absorbing fiber.

Figure 3:
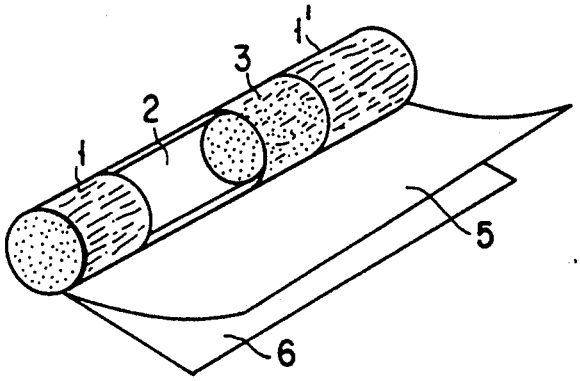
FIG. 3 is an oblique view, partly broken away, showing a smoking article according to another embodiment of the present invention.

FIG. 3 is an oblique view showing a smoking article according to another embodiment of the present invention. The smoking article of this embodiment is of cartridge type, and is put in the holder of a tobacco pipe or the like, as shown in FIG. 4.

Figure 4:
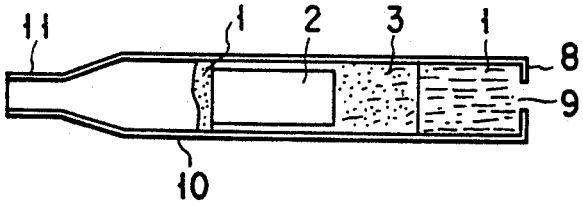
FIG. 4 shows how the smoking article shown in FIG. 3 is used.

The same reference numerals in FIGS. 1, 3 and 4 denote the same members of the smoking article. In the embodiment shown in FIG. 3, the supporting member included in the embodiment shown in FIG. 1 is replaced by a filter 1' equal in function to the back-up filter 1 so as to shorten the smoking article and, thus, to vide a cartridge type article. It is possible to prepare the filter 1' by using a material substantially equal to that used for preparing the back-up filter 1. The embodiment of FIG. 3 is exactly the same in construction, function and produced effect as the embodiment of FIG. 1, except that the supporting member 4 in FIG. 1 is replaced by the filter 1' in FIG. 3.

In order to taste the aromatic components of a flavour by using a cartridge type smoking article as shown in FIG. 3, the plastic container 2 is broken first as in the smoking article shown in FIG. 1. Then, the cartridge type smoking article is put in a tubular holder 10, as shown in FIG. 4. The holder 10 is formed of a flexible resin such as polyvinyl chloride resin. The diameter in one end portion of the holder 10 is diminished so as to form a mouth portion 11. A holder cap 8 having an air hole 9 formed in the center is mounted to the other open end of the tubular holder 10. In general, the aromatic components are sucked through the back-up filter 1 contiguous to the plastic container 2. However, it is possible to suck the aromatic components through the filter 1' contiguous to the water absorbing layer 3, if the user wishes to inhale the aromatic components more strongly.

As apparent from the foregoing description, the fragrance tasted by the user of the smoking article of the present invention is derived from the flavour solution housed in the plastic container 2. Exemplified in the following are the flavour solutions which are preferably used in the smoking article of the present invention.

PREPARATION EXAMPLE 1

A tobacco type flavour composition given below was prepared:

| | Parts by weight |
|---|---|
| α-terpineol | 3.0 |
| Ethyl phenyl acetate | 4.0 |
| α-limonene | 5.0 |
| β-ionone | 8.0 |
| Vanillin | 30.0 |
| Menthol | 30.0 |
| Furfural | 10.0 |
| Benzaldehyde | 40.0 |
| β-caryophyllene | 40.0 |
| Barley tobacco flavor | 200.0 |
| Ethyl alcohol | 200.0 |
| Propylene glycol | 230.0 |
| Water | 200.0 |
| | 1000.0 |

The composition given above was housed in an amount of 50 to 200 μl in the plastic container of the smoking article as shown in FIG. 1. Produced was a strong impression of typical palatable and smelling flavor inherent in tobacco.

PREPARATION EXAMPLE 2

A menthol type flavour composition given below was prepared:

| | Parts by weight |
|---|---|
| l-Menthol | 300.0 |
| Methyl salicylate | 5.0 |
| Clove oil | 5.0 |
| Cinnamic aldehyde | 5.0 |
| Casia oil | 10.0 |
| Spearmint oil | 100.0 |
| Anise oil | 2.0 |
| Thyme oil | 3.0 |
| Ethyl alcohol | 200.0 |
| Propylene glycol | 170.0 |
| Water | 200.0 |
| | 1000.0 |

The composition given above was housed in an amount of 50 to 200 μl in the smoking article shown in FIG. 1. Produced was a prominent impression of typical palatable and smelling flavor reminding the user of the smoking article of the cool refreshing feel of the menthol and of the spicy taste and aroma.

PREPARATION EXAMPLE 3

A vanilla type perfume composition given below was prepared:

| | Parts by weight |
|---|---|
| Vanillin | 22.0 |
| Ethyl vanillin | 5.0 |
| Maltol | 0.5 |
| Cinnamon oil | 22.0 |
| Fennel oil | 2.0 |
| Spearmint oil | 20.0 |
| Peppermint oil | 1.0 |
| Aldehyde $C_{16}$ | 6.0 |
| Ethyl butylate | 8.0 |
| Ethyl alcohol | 413.5 |
| Propylene glycol | 200.0 |
| Water | 300.0 |
| | 1000.0 |

The composition given above was housed in an amount of 50 to 200 μl in the smoking article shown in FIG. 1. Produced was a prominent impression of typical palatable and smelling flavor reminding the user of general vanilla.

As described above, it is possible to use various kinds of flavour compositions in the smoking article of the present invention. In the present invention, the amount of the aromatic components inhaled by the user of the smoking article can be controlled without difficulty. In addition, it is possible to prevent the loss of the flavour composition during preservation of the smoking article.

We claim:

1. A smoking article, comprising a flexible casing which is liquid-tight and tubular, a mouth portion formed at an end of said casing, a cylindrical plastic container which can be elastically deformed and is arranged within said casing, a flavour solution housed in said plastic container and having a viscosity of 520 cP or less, a thin wall portion formed at one end wall of said plastic container, said thin wall portion being broken when said plastic container is elastically deformed upon receipt of force applied from outside said casing so as to permit release of said flavour solution, and a water absorbing layer formed adjacent to said end wall having said thin wall portion formed therein so as to hold the flavour solution released from the plastic container, said water absorbing layer being formed of an unwoven fabric shaped from a mixture consisting of a water absorbing fiber and a heat fusible composite fiber.

2. The smoking article according to claim 1, wherein said water absorbing layer further contains shredded tobacco.

3. The smoking article according to claim 1, wherein the resistance to air flow throughout the entire smoking article is 200 $mmH_2O$ or less.

* * * * *